United States Patent [19]

Eden

[11] Patent Number: 4,458,617

[45] Date of Patent: Jul. 10, 1984

[54] BOARD SAILING HARNESS

[75] Inventor: Chris E. Eden, Javea, Spain

[73] Assignee: John M. Beall, Jr., Milford, Mich.

[21] Appl. No.: 246,138

[22] Filed: Mar. 23, 1981

[30] Foreign Application Priority Data

May 6, 1980 [ES] Spain ..... 250.536

[51] Int. Cl.[3] ..... B63H 9/08

[52] U.S. Cl. ..... 114/39; 182/3

[58] Field of Search ..... 441/74; 114/39; 182/2-9, 231-235; 403/223; 224/185, 163, 224

[56] References Cited

U.S. PATENT DOCUMENTS

| | | | |
|---|---|---|---|
| 301,923 | 7/1884 | Reisdorf | 182/7 |
| 2,437,843 | 3/1948 | Van Ness | 403/223 |
| 2,478,004 | 8/1949 | Newell | 182/3 |
| 2,559,981 | 7/1951 | McBride | 182/5 |
| 2,969,656 | 1/1961 | Reuter | 403/223 |
| 3,106,037 | 10/1963 | Harkey | 224/185 |
| 3,703,218 | 11/1972 | Brda | 182/6 |
| 3,784,068 | 1/1974 | Pistilli | 224/185 |
| 3,879,024 | 4/1975 | Scott et al. | 403/220 |
| 4,068,610 | 1/1978 | Tesan | 115/24.1 |
| 4,083,480 | 4/1978 | Lee et al. | 224/185 |

FOREIGN PATENT DOCUMENTS

| | | | |
|---|---|---|---|
| 2802302 | 1/1978 | Fed. Rep. of Germany . | |
| 2824465 | 6/1978 | Fed. Rep. of Germany . | |
| 2835579 | 2/1980 | Fed. Rep. of Germany | 114/39 |
| 2920011 | 11/1980 | Fed. Rep. of Germany | 114/39 |

*Primary Examiner*—Trygve M. Blix
*Assistant Examiner*—Thomas J. Brahan
*Attorney, Agent, or Firm*—Gifford, VanOphem, Sheridan, Sprinkle & Nabozny

[57] ABSTRACT

A connector device for board sailors is provided and includes a body engaging harness which supports a boom engaging device. The boom engaging device comprises an elongated arm having a rotatable spool member which is positioned on and compressably engageable against the boom of the board sailing craft. The length of the arm supporting the rotatable spool is adjustable so that the device can be used by board sailors of varying heights. Moreover, the support arm is angularly adjustable with respect to the body engaging harness so that the boom serves to support the weight of the board sailor when the board sailor hangs out from the side of the sail surfing vessel to counteract the force of the wind exerted upon the sail and to control the direction of the sail craft but permits ready disengagement between the board sailor and the craft when the craft begins to capsize or the sail begins to fall.

13 Claims, 6 Drawing Figures

BOARD SAILING HARNESS

BACKGROUND OF THE INVENTION

I. Field of the Invention

The present invention relates generally to harnesses for removably securing a person to a board sailing vessel and, more particularly, to such a harness provided with a connection device having an open channel member compressively engaged against the boom of the board sailing vessel by body movement of the person wearing the harness.

II. Description of the Prior Art

It has long been known that sails can be applied to floating vessels in order to utilize the power of the wind to propel the vessel across a body of water. An outgrowth of this form of transportation has engendered the increasingly popular sport of board sailing.

A board sailing vessel typically comprises a surfboard to which a mast is secured in order to support a sail above the top surface of the surfboard. As is well known, a rig is provided which includes a boom extending outwardly from the mast so that the position of the sail with respect to the direction of the surfboard can be controlled by the board sailor standing on the surfboard. Typically, the boom extends along both sides of the sail so that the boom can be grasped by the board sailor regardless of his direction or the direction of travel of the vessel. Of course, the direction of the surfboard is controlled by movement of the rig and the speed of the vessel is varied by adjusting the trim of the sail.

In addition, the boom can also be used to support the board sailor when he hangs out from the side of the vessel in order to counteract the strong force exerted by the wind upon the sail in order to keep the vessel in an upright position and the sail in full contact with the wind. Although such hanging out is necessary in order to maximize the performance of the board sailing vessel, it is strenuous and can become extremely tiresome when the wind is strong or the vessel is being ridden for a long distance. Thus, some harnesses have been developed in order to relieve the strain upon the board sailor while he is hanging out from the boom of the board sailing vessel.

Most such harnesses include a body engaging harness comprising shoulder straps and a waist strap. The body engaging harness supports a means for detachably securing the operator to the boom. One of the previously known harnesses includes a chest strap which supports a hook. A rope loop connected to the boom is secured to the hook. The board sailor pulls the boom toward him until the rope passes over and engages the hook. The board sailor can then lean back away from the boom and is supported by the rope and the hook arrangement. However, in order to release from the vessel, the board sailor must be able to again pull the boom toward him so that the rope drops out of the hook. Such a release mechanism is disadvantageous for the reason that a sudden gust of wind may prevent the board sailor from pulling himself toward the boom and thus, releasing himself from the vessel. Moreover, a sudden gust of wind can unexpectedly catapult the board sailor over the craft. Thus, the rope may twist around the hook and prevent the rope from dropping out of the hook. Consequently, the board sailor can be severely endangered unless the body engaging harness is also provided with an additional quick release means so that the entire harness can be quickly removed from the body of the board sailor.

Another known type of strength saving device is known as the Charchulla Channel System. Such a harness comprises a broad leather strap which is buckled around the hips. A track is secured to the boom and an adjustable line attached to the leather strap is held fast by a cam cleat in the track on the boom. The end of the line is held by the sheet hand of the board sailor. To release the harness before tacking or falling, the sheet hand pulls the rope out of the cleat. Such a harness provides increased safety because the board sailor can easily release himself from the boom. However, such a device is disadvantageous because the board sailor must release one hand from the boom in order to cleat the rope.

Another previously known and simple retaining device comprises a chest harness to which hinged hooks are attached by means of a line. The hook is hung over the boom to support the board sailor therefrom. A release line engages a small sleeve which, in turn, disengages the hook from the boom as the release line is pulled by the hand of the board sailor. Unfortunately, such a device still requires that the board sailor remove one hand from the boom in order to engage the hook on the boom. Moreover, after the hook has been released from the boom as in a fall or after tacking, both of the board sailor's hands are required to reassemble the hook and sleeve arrangement for reattachment to the boom.

A still further known retaining device comprises a pair of curved, hard molded, rubber gloves, each glove being secured to a chest harness by lines. The board sailor's hands are inserted into the gloves and the boom is thus easily gripped. While hanging out, the line securing the gloves to the chest harness supports a portion of the load normally applied to the arms of the board sailor. Although such a device provides quick release from the boom by simply removing the board sailor's hands from the boom, the length of the line securing the gloves to the harness must correspond to the length of the arms of the board sailor. Moreover, the device is operative only while the board sailor's hands grip the boom. Thus, the arms of the board sailor are constantly subjected to some stress and strain while the retainer is operative to support the board sailor's weight from the boom. In addition, as with the other mechanical devices which utilize lines to support the board sailor's weight from the boom, the lines can become tangled around the vessel or the body of the board sailor when the board sailor falls or the vessel capsizes. Consequently, such harnesses present additional risk of danger to the board sailor.

SUMMARY OF THE PRESENT INVENTION

This invention overcomes the above-mentioned disadvantages by providing a connector device for a board sailor which utilizes a rigid arm to support the weight of the board sailor from the boom. One end of the rigid support bar is supported by a support plate secured to a torso harness. The other end of the support bar includes a rotatable member which includes an open channel roller adapted to receive the boom therein. The support bar is pivotally secured to the support plate so that the bar can be pivoted away from the body of the board sailor. This enables the board sailor's body to be angled outwardly or away from the side of the board sailing vessel while the rotatable channel member continuously engages the boom of the board sailing craft. Nevertheless, the boom engaging member can be easily detached from the boom. Preferably, the length of the support rod is adjustable so that the height of the rotatable channel member is adjustable, whereby the connector device can be used by any board sailor regardless of his or her size.

BRIEF DESCRIPTION OF THE DRAWING

These and other important features will be better understood by reference to the following detailed description of the preferred embodiment of the present invention when read in conjunction with the accompanying drawing in which.

DETAILED DESCRIPTION OF A PREFERRED EMBODIMENT OF THE PRESENT INVENTION

Figure 1:
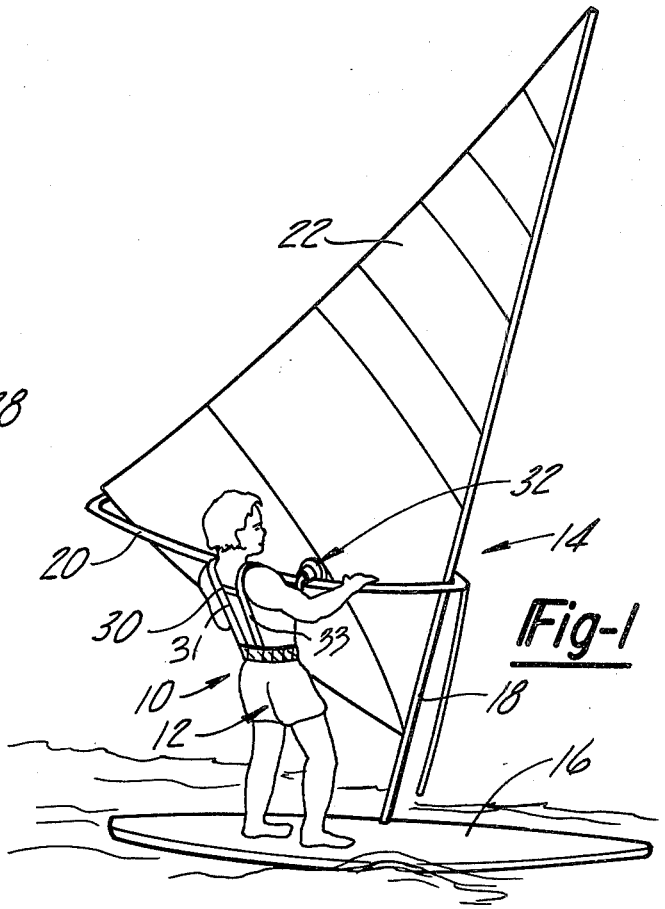
FIG. 1 is a perspective view of a craft and a sailor wearing the connector device of the present invention.

Referring now to FIG. 1, the connector device 10 of the present invention is thereshown being worn by a board sailor 12 while astride the board sailing craft 14. The board sailing craft 14 generally comprises a surfboard 16 to which a vertical mast 18 is secured by a universal connection as is common. The mast 18 supports a sail 22. A boom 20 extending along both sides of the sail 22 projects outwardly from the mast 18 so that the sail 22 can be repositioned about the mast 18 in a desired position. As shown in FIG. 1, a portion of the connector device 10 engages the boom 20 and serves to support the sailor 12 in a manner to be described in detail hereinafter.

The connector device 10 is attached to a body harness 30 and includes a boom engagement portion 32. The body harness 30 comprises a pair of shoulder straps 31 and 33 secured to a support plate 38 through slots 39. A waist belt 34 is received through spaced, parallel slots 36 in the support plate 38 so that the plate 38 bears against the front of the board sailor 12. The boom engaging portion 32 of the connector device 10 is secured to the plate 38 (see FIG. 3).

Figure 2:
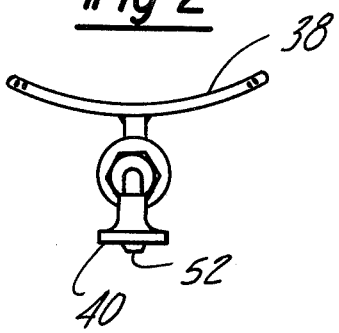
FIG. 2 is a top plan view of a preferred embodiment of the boom supporting portion of the device shown in FIG. 1.
Figure 3:
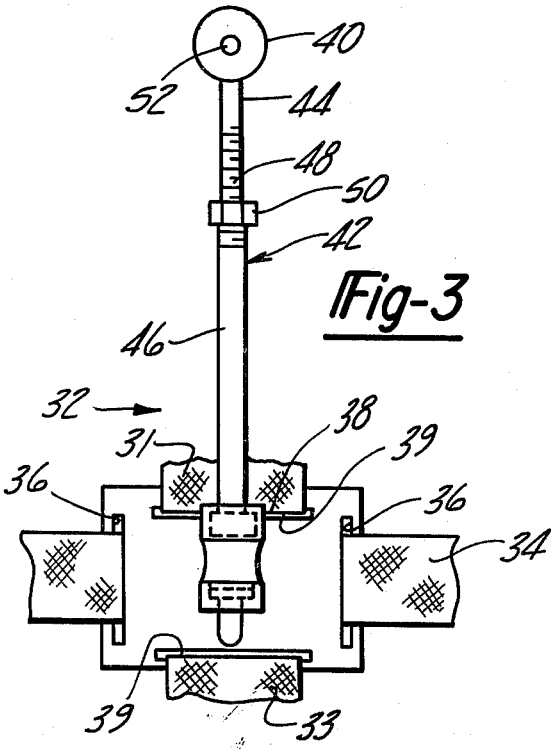
FIG. 3 is a front plan view of the boom engaging portion of the device shown in FIGS. 1 and 2.
Figure 4:
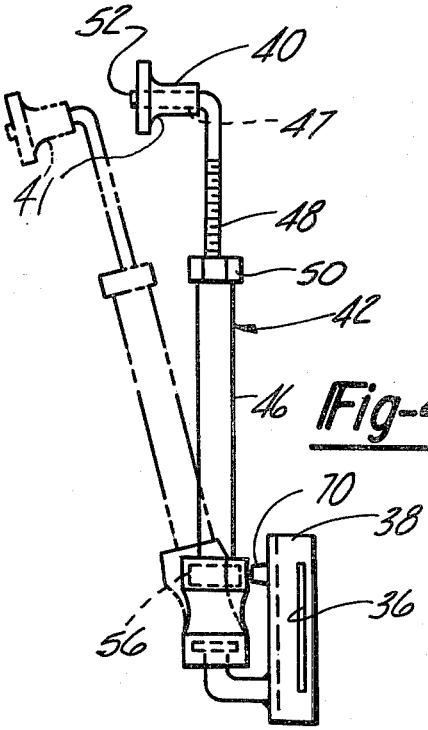
FIG. 4 is a side plan view of the device shown in FIGS. 2 and 3.

Referring now to FIGS. 2 through 4, the boom engaging portion 32 of the connector device 10 comprises a spool 40 rotatably secured to the free end of a support arm 42. The support arm 42 includes a first elongated portion 44 and a second elongated portion 46. The first portion 44 includes an externally threaded portion 48 which is threadably engaged in an axial bore in the arm portion 46. A nut member 50 is threadably engaged upon the threaded portion 48 so that the upper arm portion 44 can be lockingly engaged with the lower arm portion 46 regardless of the extent to which the threaded portion 48 is engaged within the axial bore of the portion 46. The upper end 47 of the arm 44 is bent normal to the threaded portion 48 and defines the axis about which the spool 40 rotates. As best shown in FIGS. 1 and 4 the spool wholly defines the open channel that receives the boom. Locking means such as the nut 52 retains the spool in position on the outwardly extending portion 47 of the arm 42.

Figure 5:
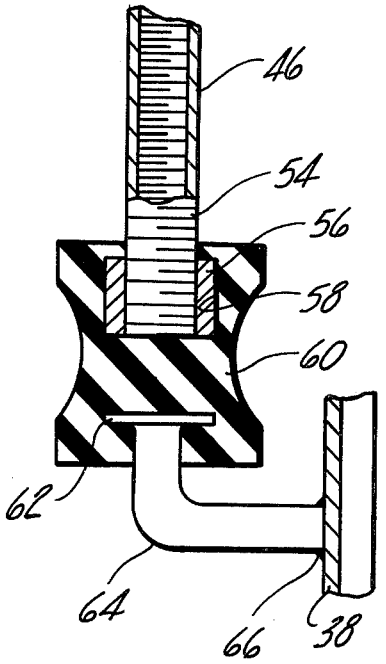
FIG. 5 is a fragmentary sectional view of the portion of the device shown in FIGS. 2 through 4.

As best shown in FIG. 5, the lowermost end of the arm portion 46 includes an externally threaded portion 54. The portion 54 threadably engages an internally threaded sleeve 56 entrained within a recessed bore 58 in one end of a resilient connector bushing 60. It should be clear, however, that other means of connecting the arm 42 to the resilient connector 60 could be used. Nevertheless, the connector bushing 60 is particularly advantageous for the reason that it acts as a means for substantially vertically supporting the support arm 42 as well as a means for angularly adjusting the arm 42.

The other end of the resilient connector 60 engages a radially extended flange 62 secured to the end of one shank of an L-shaped support rod 64. The other end of the L-shaped shank 64 is secured to the plate 38 as by welds 66 or the like. It should be clear that other means can be employed to attach the resilient block 60 to the plate 38. The embedded flange 62 is spaced apart from the recessed sleeve 56 by a solid but reduced diameter portion of the connector 60 so that the arm 42 is angularly adjustable with respect to the L-shaped rod 64 although it normally retains the arm 42 in an upright or vertical position. The resilient connector 60 thus provides a resilient and an elastic connection between the plate 38 and the boom 20 which aids in removing the device from the boom 20 and returns it to a normal position upon release as will be clearer as the description proceeds.

As shown in FIG. 4, the plate 38 also includes a stop member 70 extending outwardly therefrom toward the upper portion of the connector 60 adjacent the recessed sleeve 56. The stop 70 abuts against the connector 60 when the arm 42 is in its vertical position to prevent the arm from angling backward toward the upper body of the board sailor 12. Nevertheless, as shown in FIG. 4, the arm 42 is free to pivot away from the body of the surfer as shown in phantom line in that figure.

Having thus defined the structural features, the operation of the device shown in FIGS. 2 through 5 can be easily described. The body harness 30 strapped over the shoulders of the board sailor 12 so that the waistband 34 extends around the waist of the board sailor 12. Belt 34 is looped through the slots 36 in the support plate 38 and thereby connects the support portion 32 to the body of the board sailor 12. The strap 31 extends over one shoulder of the board sailor 12 and the strap 33 is looped upwardly to extend over the other shoulder of the board sailor 12.

The height of the spool 40 is adjusted by screwing or unscrewing arm portion 44 with respect to arm portion 46, so that the channel 41 in the spool 40 engages the top of the boom 20 when the board sailor is standing on the surfboard 16 and the support arm 42 is in its normally biased upright position. With the height of the roller 40 fixed by nut 50, the board sailor 12 then moves his body toward the boom 20 and engages the spool 40 on top of the boom 20 so that the boom 20 rides in the channel 41 of the spool. The surfer can then move fore and aft along the surfboard 16 while the spool continues to be compressed against the boom 20 and thereby offers support to the body of the board sailor 12. Moreover, the spool 40 continues to engage the boom when the board sailor 12 leans away from the boom 20 and extends his body outwardly past the side of the surfboard 16 to counteract the force of the wind tending to tip the sail 22 in the opposite direction. Consequently, the support device 32 suspends the body of the surfer from the boom 20 and thus reduces the strain and stress upon the arms of the surfer. Nevertheless, when a sudden gust of wind causes the vessel to capsize, or when the board sailor decides to change direction by tacking, i.e. moving the boom to the opposite side of the craft, the spool 40 is easily displaced from the boom by lifting or by sliding the spool. This release from the boom is easily accomplished because the board sailor merely pulls himself toward the boom 20 and thereby release the spool 40, and thus the entire device, from the boom 20. The resilient block 60 in attempting to return the stem 46 to an upright position actually causes the end of the spool to engage boom 20 and push the sailor 12 away from the craft. The block 60 also ensures that there is sufficient flexibility in the connector device 10 to reduce the likelihood of injury as the board surfer 12 falls into the water or onto the board 16. It will be understood that an arcuately shaped channel 41 (FIG. 4) increases the ease with which the boom slides out of the spool.

Figure 6:
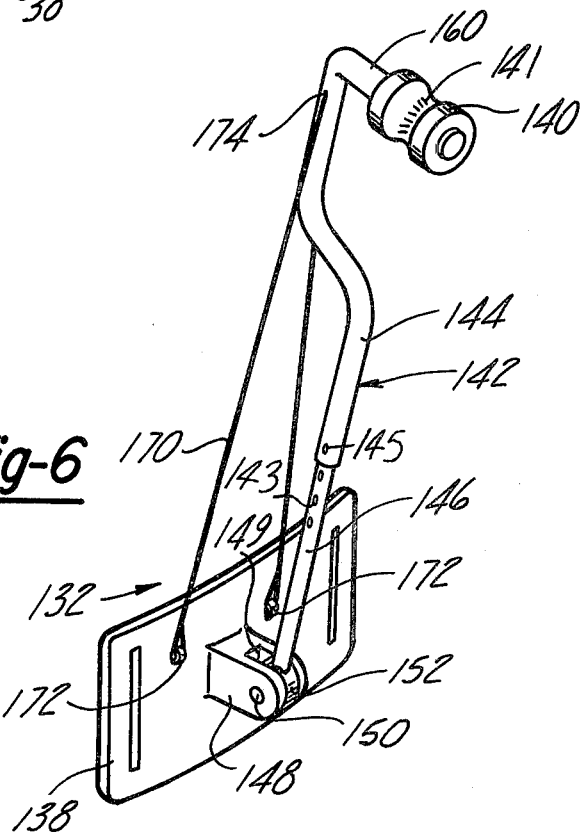
FIG. 6 is a perspective view of the boom engaging portion of the connector device but showing a modification thereof.

A modified connector device similar to the device shown in FIGS. 2 through 5, is shown in FIG. 6 as support means 132. The support means 132 comprises a support plate 138 substantially the same as the plate 38. A support block 148 extends outwardly from the front of the plate 138 and includes a pair of outstretched flanges in which a pivot pin 150 is journalled. A pivot sleeve 152 is entrained between the flanges and about the pivot pin 150, and is secured to the lowermost end of the rod 144 of support arm 142. The upper portion of support rod 146 is slidably received in the lower end of the tube portion 144 of support arm 142. The support rod 146 includes a plurality of aligned, diametric apertures 143 therethrough which are selectively registrable with diametric apertures 145 in the support tube 144. A locking pin is engaged through registering apertures 145 and 143 to fix the length of the support bar 142 above the support plate 138.

The uppermost portion of the support tube 144 is recessed inwardly toward the body of the board sailor so that the outwardly extended portion 160 supports the spool 140 above the lower portion of the support arm 142. Such a recessed position of the roller 140 minimizes the amount of body movement which is necessary to engage and disengage the spool 140 from the boom 20. In addition, angular movement of the support arm 142 toward the body of the board sailor is limited by the stop member 149 of the support block 148. Preferably, the stop member 149 maintains the support arm 142 at an angle with respect to the vertical so that a channel 141 on the spool 140 engages the boom 20 beyond the top dead center point of the boom 20 and thus increases the locking engagement between the spool 140 and the boom 20.

The support arm 142 is normally retained in its uppermost position by elastic, resilient line 170. As shown, the line 170 is secured at both ends to the plate 138 and extends through an aperture 174 in the support tube 144. Although the line 170 can be looped around plate indentations 172 on the support plate 138, other types of connectors and means for biasing the support arm 142 are also within the scope of the present invention. In any event, the tension in the elastic line 170 normally retains the support arm 142 in its uppermost position and it also reduces the problem of entanglement.

It will be understood that regardless of the particular structure utilized, the connector device of the present invention provides a secure but easily disengageable body support for a board sailing craft. The rotatable spool easily tracks along the length of the boom while the board sailor moves fore and aft or hangs out from the side of the craft. Nevertheless, the spool is easily disengaged from the boom when a sudden gust of wind threatens to capsize the vessel or when the surfer desires to reverse the direction of the board sailing craft. Moreover, the device can be used by all board sailing enthusiasts regardless of their height since the length of the support arm is easily adjustable.

Having thus described my invention, many modifications thereto will become apparent to those skilled in the art to which it pertains without departing from the scope and spirit of the present invention as defined in the appended claims.

What is claimed is:

1. A board sailing connector device for detachably securing a person to the boom of a board sailing craft comprising:
   - a support plate;
   - first means for securing said support plate to the front of the person's body;
   - an elongated support stem;
   - second means for substantially vertically supporting said support step from said support plate;
   - an open channel means secured to the upper part of said support stem and engageable with said boom, said channel means comprising a rotatable member having its axis of rotation substantially perpendicular to and extending outwardly from said support stem and having an axial length substantially corresponding to the diameter of the boom of the board sailing craft, whereby said rotatable member can engage a portion of the circumference of the boom and roll therealong;
   - wherein said second means comprises means for angularly adjusting said stem with respect to said support plate and means for normally biasing said support stem to assume a substantially vertical position;
   - wherein said second means comprises a resilient bushing.

2. The invention as defined in claim 1 wherein said first means comprises a belt.

3. The invention as defined in claim 1 wherein the upper end of said support stem includes an outwardly bent end portion and wherein said rotatable member is coaxially and rotatably secured to said end portion.

4. The invention as defined in claim 1 and further comprising means for adjusting the height of said rotatable member above said support plate.

5. The invention as defined in claim 1 wherein said second means comprises a resilient support member connecting said support stem and said support plate.

6. The invention as defined in claim 1 wherein said rotatable member is spool shaped.

7. A board sailing connector device for detachably securing a person to the boom of a board sailing craft comprising:
   - a support plate;
   - first means for securing said support plate to the front of the person's body;
   - an elongated support stem in the form of a rod having an elongated support arm portion and a transverse portion;

second means for substantially vertically supporting the support arm portion of said support stem from said support plate so that said transverse portion extends outwardly away from said support plate;

an open channel means secured to the upper part of said support stem and engageable with said boom, said channel means comprising a rotatable member and means for rotatably securing said rotatable member about said transverse portion, said rotatable member having its axis of rotation substantially perpendicular to said support arm portion of support stem and having an axial length substantially corresponding to the diameter of the boom of the board sailing craft, whereby said rotatable member can engage a portion of the circumference of the boom and roll therealong.

8. The invention as defined in claim 7 wherein said second means comprises a resilient bushing; and means for connecting the lower end of said support stem at one end of said bushing.

9. The invention as defined in claim 8 wherein said resilient bushing includes a first and a second end and a central portion and further comprising a support rod, means for securing said support rod to said support plate and means for connecting said support rod at one end of said bushing.

10. The invention as defined in claim 9 wherein said support rod is substantially L-shaped.

11. The invention as defined in claim 9 wherein said support stem and said support rod are embedded in the first and second ends, respectively, of said bushing.

12. The invention as defined in claim 7 wherein said second means comprises means for angularly adjusting said stem with respect to said support plate and means for normally biasing said support stem to assume a substantially vertical position.

13. A board sailing connector device for detachably securing a person to the boom of a board sailing craft comprising:

a support plate;

first means for securing said support plate to the front of the person's body;

an elongated support stem;

second means for substantially vertically supporting said support stem from said support plate;

an open channel means secured to the upper part of said support stem and engageable with said boom, said channel means consisting of a rotatable member, and means for rotatably supporting said rotatable member so that its axis of rotation is substantially perpendicular to and extends outwardly from said support stem, said rotatable member having an axial length substantially corresponding to the diameter of the boom of the board sailing craft, and wherein said rotatable member wholly defines the entire open channel, whereby the rotatable member can engage a portion of the circumference of the boom and roll therealong, but disengagement of said rotatable member from said boom completely disengages the device from the boom.

* * * * *